United States Patent [19]

Martineau

[11] 4,343,430

[45] Aug. 10, 1982

[54] ENVELOPE ASSEMBLY FOR MANUFACTURE AS A PRESTUFFED CONTINUOUS FORM

[75] Inventor: Jean-Claude P. Martineau, Thurso, Canada

[73] Assignee: Canada Post Corporation/Société Canadienne de Postes, Ottawa, Canada

[21] Appl. No.: 249,213

[22] Filed: Mar. 30, 1981

[30] Foreign Application Priority Data

Jun. 20, 1980 [CA] Canada ..... 355656

[51] Int. Cl.[3] ..... B65D 27/08; B65D 27/10

[52] U.S. Cl. ..... 229/69; 229/72; 206/629

[58] Field of Search ..... 229/69, 72; 206/610, 206/611, 629; 282/11.5 A, 25

[56] References Cited

U.S. PATENT DOCUMENTS

| | | | |
|---|---|---|---|
| 2,824,685 | 2/1958 | Patton | 229/69 |
| 3,273,785 | 9/1966 | Beckman et al. | 229/69 |
| 3,820,447 | 6/1974 | Gendron et al. | 93/73 |
| 3,837,565 | 9/1974 | Johnsen | 229/68 R |
| 3,905,545 | 9/1975 | Juszak et al. | 229/69 |
| 3,918,632 | 11/1975 | Neubauer | 229/69 |

*Primary Examiner*—William Price
*Assistant Examiner*—Jimmy G. Foster
*Attorney, Agent, or Firm*—Francis W. Lemon

[57] ABSTRACT

An envelope assembly for manufacture as a prestuffed, continuous form comprises two outer panels, a partition panel and an envelope flap on one of the panels. The panels having matching, glued together pin hole feed strips along sides, between which the flap extends, and line perforations for the removal of the pin hole feed strips. The partition panel is sealed along all four sides to one of the outer panels to provide a sealed, prestuffable compartment which may be opened by tear line perforations adjacent one pin hole feed strip, and has a glue line on the other side so that the compartment on the other side remains sealed when the sealed, prestuffable compartment is opened. The envelope assembly may be used as a certified mail assembly in which case the sealed compartment is used to contain a proof-of-delivery panel, for return to the mailer, which is removed with a portion of an outer panel for retention by the Post Office, while the remainder is handed to the addressee. A removable record-of-mailing panel is also provided on the certified mail assembly for detachment and retention by the mailer before mailing the remainder.

6 Claims, 16 Drawing Figures

ENVELOPE ASSEMBLY FOR MANUFACTURE AS A PRESTUFFED CONTINUOUS FORM

Figure 1:
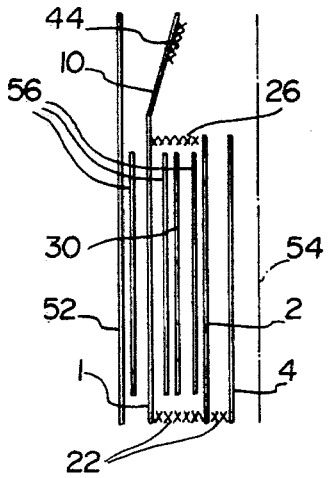

This invention relates to an envelope assembly for manufacture as a prestuffed, continuous form.

It has already been proposed in U.S. Pat. No. 3,273,785 to adhesively secure card inserts to the continuous form lower sheet of a self-mailer prior to adhesively securing a top sheet to the lower sheet to continuously form a self-mailers with card inserts therein.

Known envelope assemblies which are manufactured in continuous form are side filled and are sealed by seals extending along the pin hole feed strips, that is extending along the direction of movement of the continuous form sheets, see for example U.S. Pat. No. 3,820,447. This side filling introduces problems, the envelope throat being too narrow for insertion using conventional, mechanical insertion machines.

U.S. Pat. No. 2,824,685 teaches assembling series connected envelopes with trailing flaps and openings extending in a transverse direction to the direction of movement of the continuous forms. However, no provision is made for prestuffing the envelopes while they are being assembled in a series connected manner.

There is a need for an envelope assembly for manufacture in a prestuffed manner wherein the envelope can be stuffed in the direction of movement of the forms or in the opposite direction thereto.

There is also a need for an envelope assembly for manufacture in a prestuffed continuous form wherein provisions are made for forming a prestuffed, sealed compartment, after manufacture in a continuous form, which is openable independantly of the main pocket of the envelope assembly.

According to the present invention there is provided an envelope assembly for manufacture as a prestuffed, continuous form, comprising: two outer panels and a partition panel, all having matching pin hole feed strips along opposed sides of each panel, and an envelope sealing flap, the envelope sealing flap being integral with one of the panels, the envelope sealing flap extending between the pin hole feed strips along a flap side of the panel to which it is attached, the pin hole feed strips of all of the panels being secured together and separable from the remainder by pin hole feed strip line perforations, marginal edge portions of the remainder of all of the panels, adjacent the pin hole feed strip line perforations being secured together, the remainder of all of the panels also being secured together along their opposite sides to the flap side, and having matching envelope opening line perforations adjacent one pin hole feed strip, one of the outer panels having the partition panel secured thereto, along the side adjacent the flap, for forming a prestuffable, sealed compartment therewith, and the other of the outer panels being secured to the partition panel along an inner marginal edge portion adjacent the envelope opening line perforations, whereby the prestuffable, sealed compartment only may be opened by tearing the envelope assembly along the envelope opening line perforations.

In some embodiments of the present invention the assembly is a certified mail envelope assembly and further includes a proof-of-delivery panel removably secured in the sealed compartment, a mailer record panel removably secured to the outer side of the first panel, and data transfer means between the mailer record panel, the panel adjacent thereto, the proof-of-delivery panel, and the partition panel.

Figure 2:
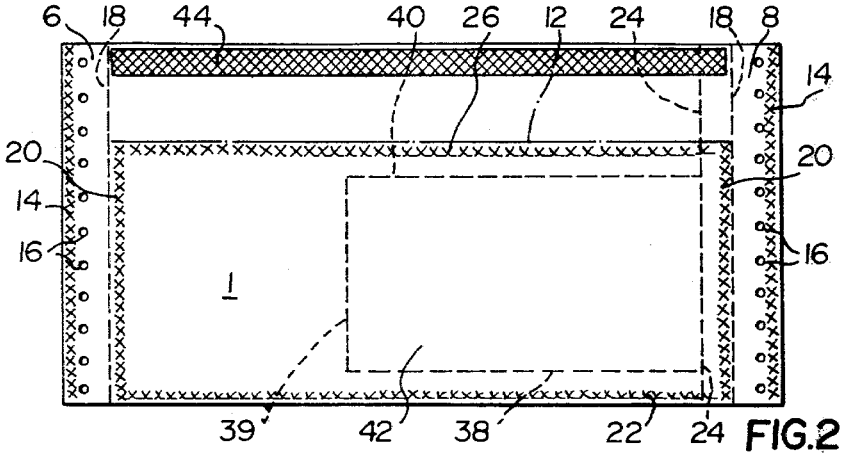
Figure 3:
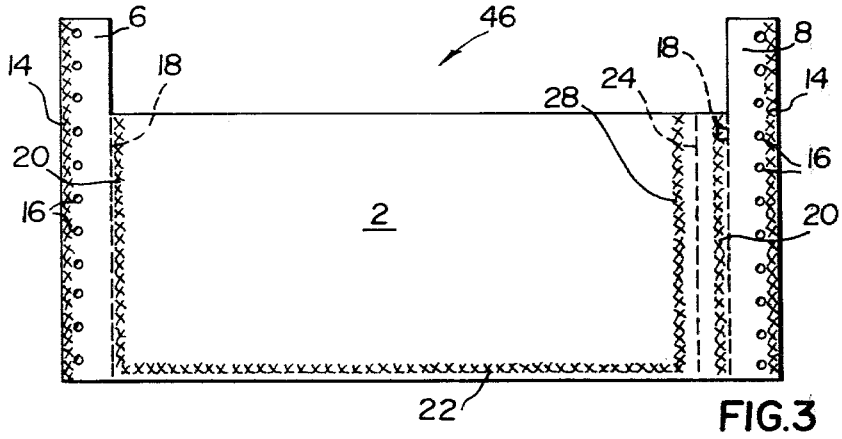
Figure 4:
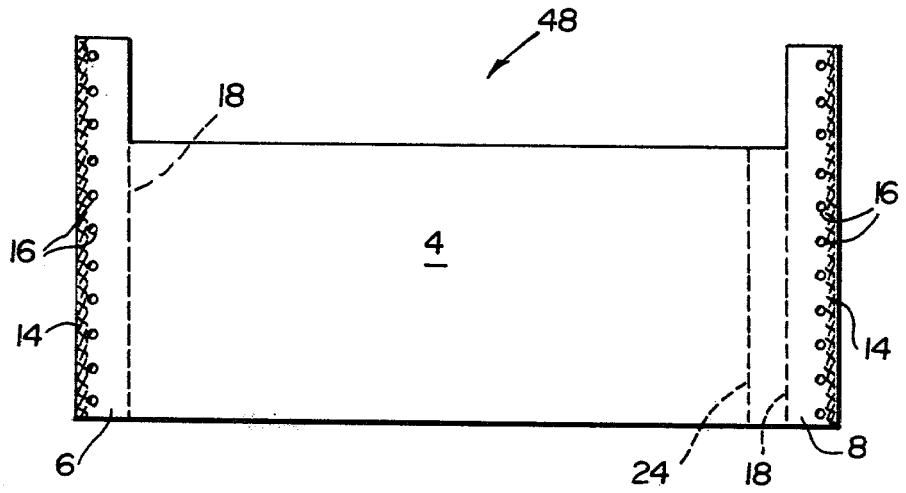
Figure 5:
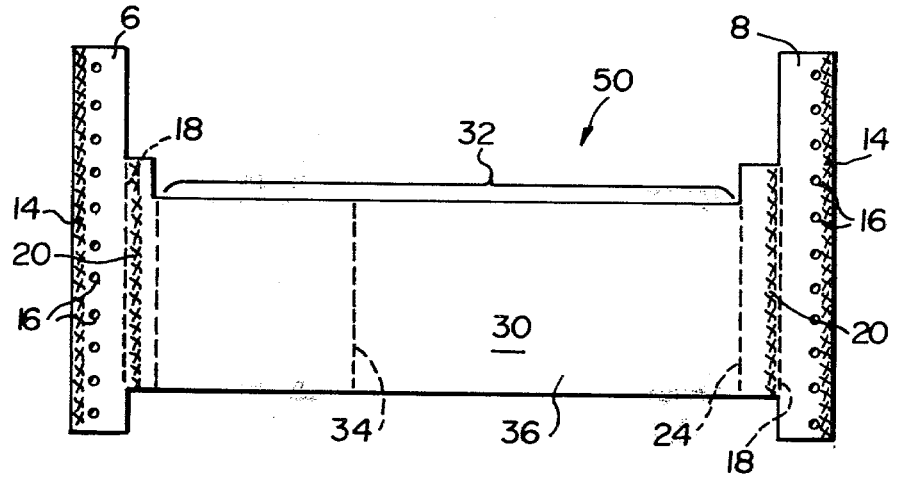
Figure 6:
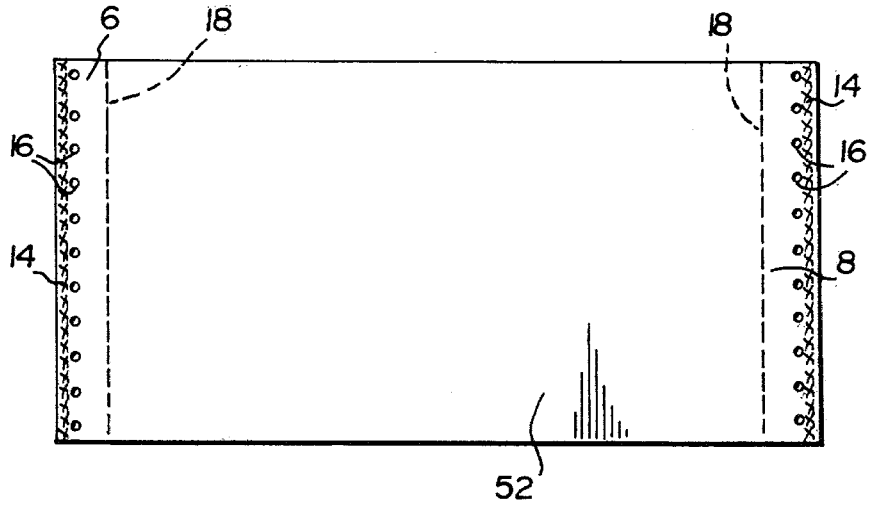
Figure 7:
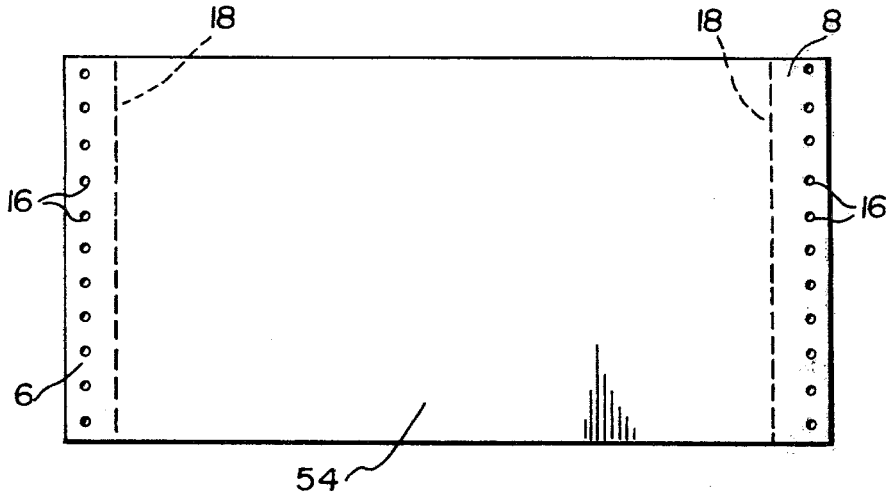
Figure 8:
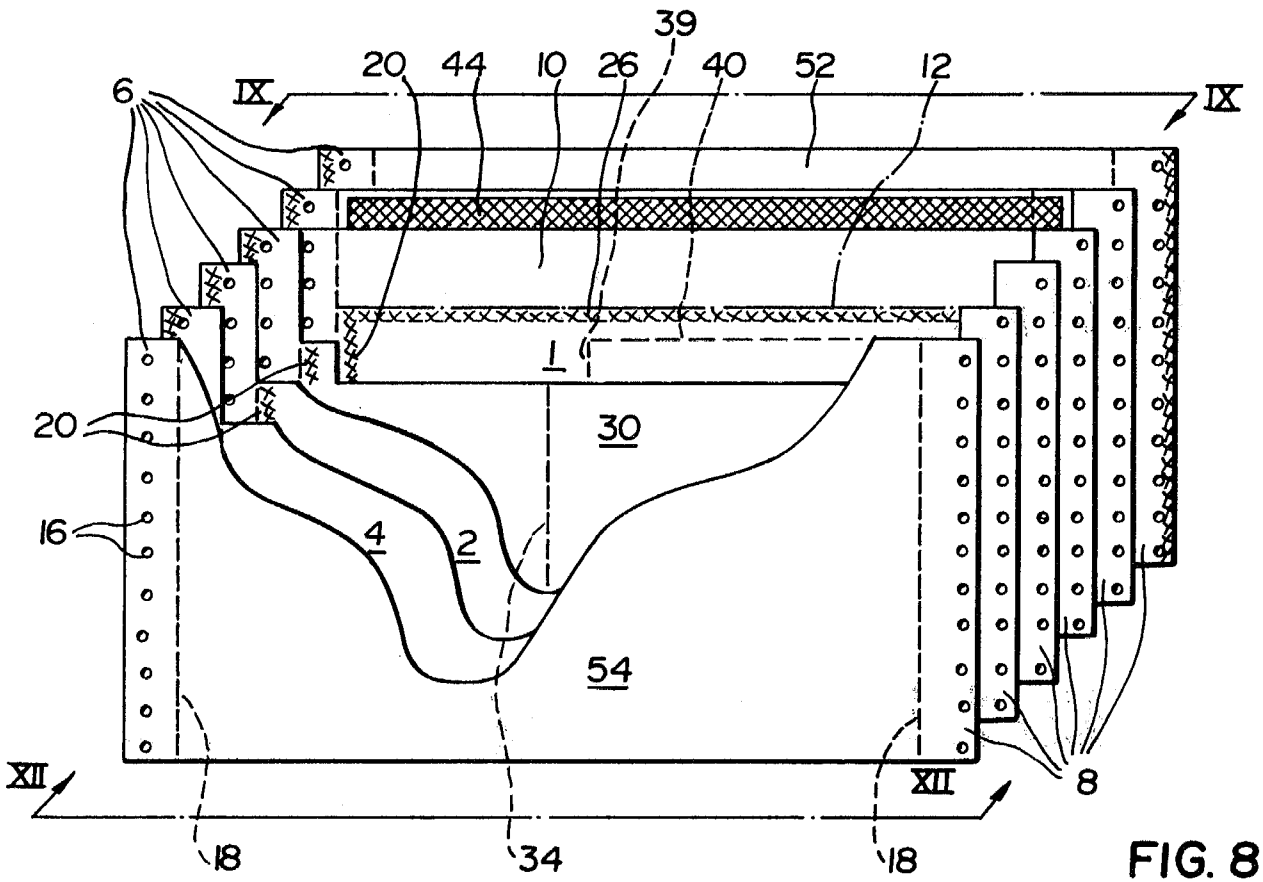
Figure 9:
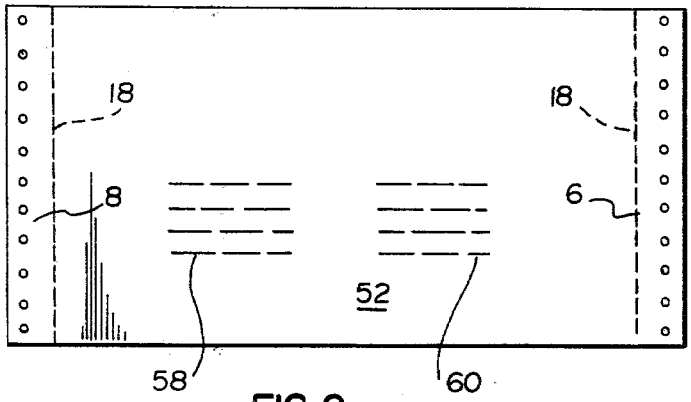
Figure 10:
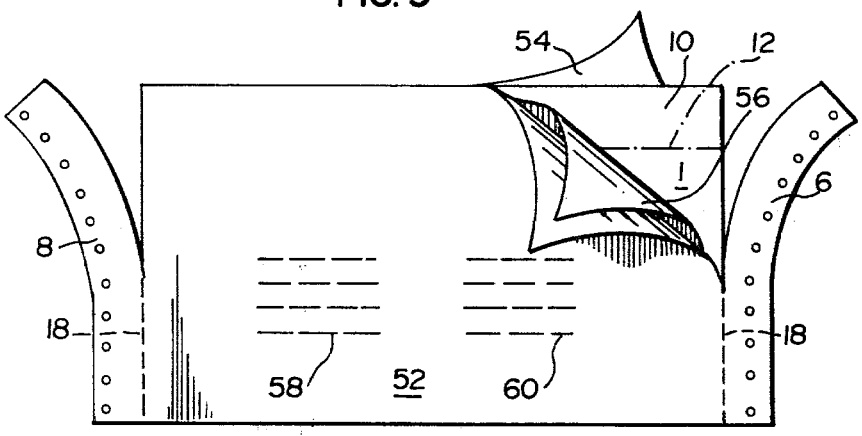
Figure 11:
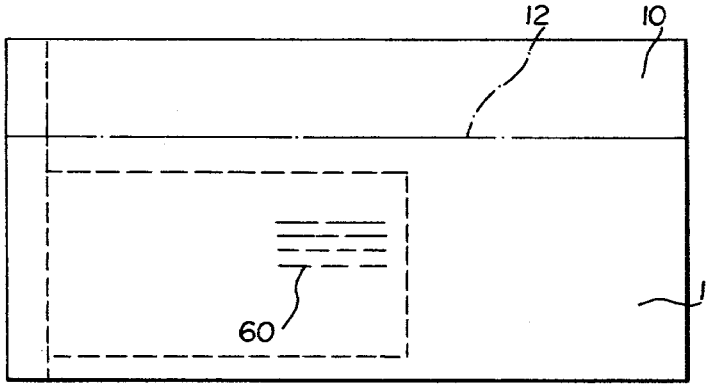
Figure 12:
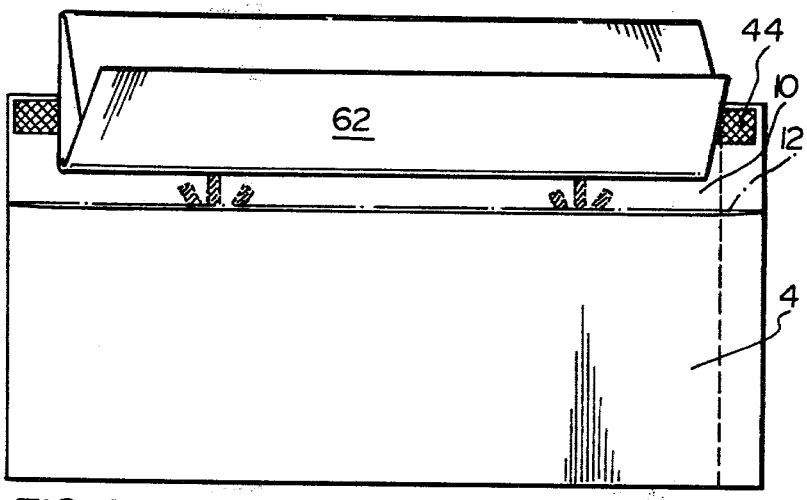
Figure 13:
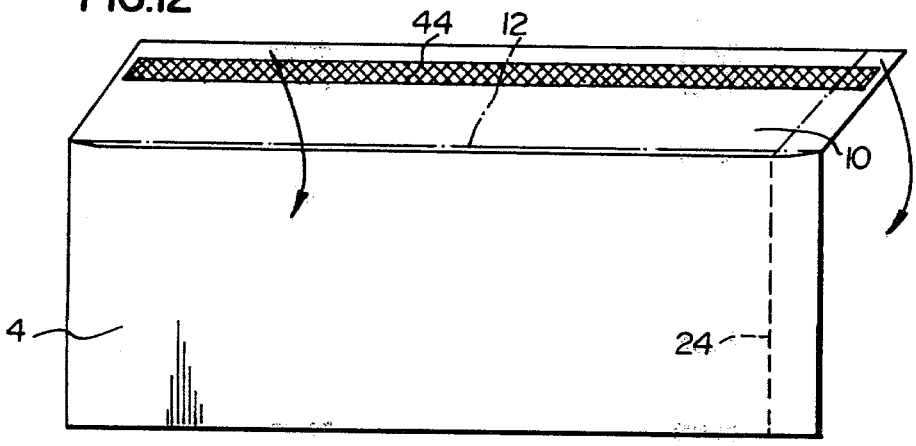
Figure 14:
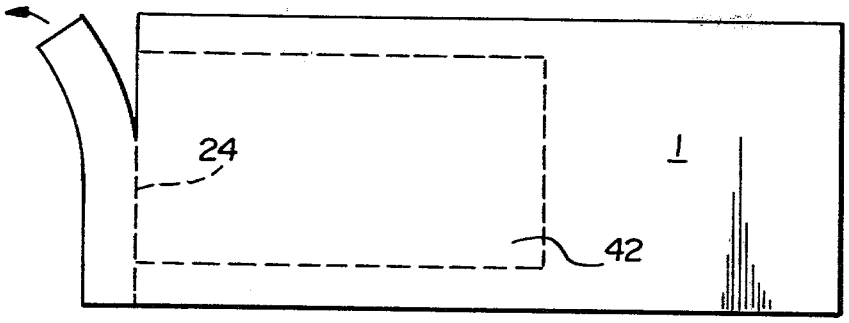
Figure 15:
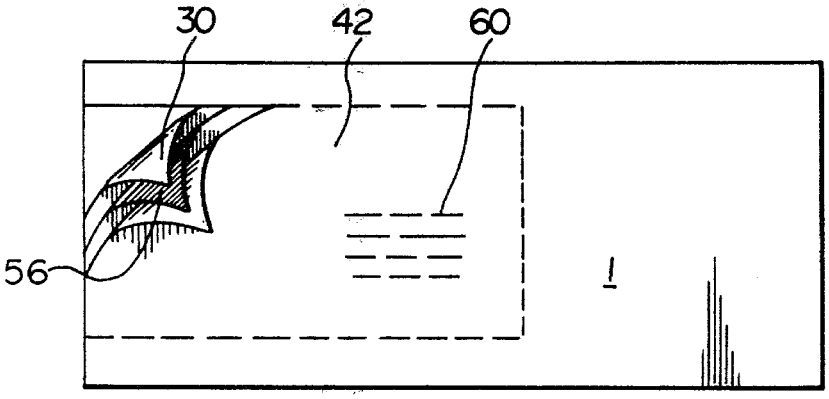
Figure 16:
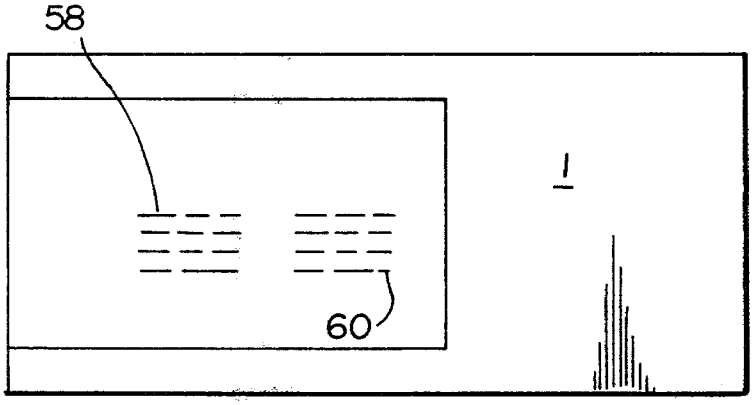

In the accompanying drawings which illustrate by way of example, an embodiment of the present invention, FIG. 1 is an exploded end view of a certified mail envelope assembly for manufacture in a prestuffed continuous form, FIG. 2 is a side view of an outer panel, and a sealing flap shown in FIG. 1, FIG. 3 is a side view of an intermediate panel shown in FIG. 1, FIG. 4 is a side view of another outer panel shown in FIG. 1, FIG. 5 is a side view of a prestuffing in the form of a proof-of-delivery, for return to the mailer, shown in FIG. 1, FIG. 6 is a side view of a mailer record shown in FIG. 1, and FIG. 7 is a printer backing sheet shown in FIG. 1, FIG. 8 is an exploded, corner view of the envelope assembly shown in FIG. 1, FIG. 9 is a side view in the direction of IX—IX, FIG. 8, FIG. 10 is a similar side view to FIG. 9 with the pin hole feed strips and printer backing sheet and the mailer record being removed, FIG. 11 is a similar side view to FIG. 10 with the pin hole feed strips, printer backing sheet and mailer record removed, FIG. 12 is a side view in the direction of XII—XII with the pin hole feed strips, printer backing strip and mailer record removed, and the mailing contents being inserted in the envelope assembly, FIG. 13 is a similar view to FIG. 12 with the sealing flap being sealed, FIG. 14 is a similar view to FIG. 11 of the delivered envelope being opened for access to the sealed compartment only, FIG. 15 is similar view to FIG. 14 with the contents of the sealed compartment being removed, and FIG. 16 is similar view to FIG. 14 after the contents have been removed from the sealed compartment.

In FIGS. 1 to 6, 8, 12 and 13 adhesive coatings are depicted by crosshatching.

In FIGS. 1 to 16 there is shown a certified mail envelope assembly for manufacture as a prestuffed, continuous form, comprising: two outer panels 1 (FIGS. 1 and 2) and 4, (FIGS. 1 and 4) and a partition panel 2 (FIGS. 1 and 3), all having matching pin hole feed strips 6 and 8 along opposed sides of each panel 1, 2 and 4, and an envelope sealing flap 10 integral with the outer panel 1, the envelope sealing flap 10 extending between the pin hole feed strips 6 and 8 along a flap side, defined by folding score 12 (shown chain dotted in FIG. 2) of the panel 1, the pin hole feed strips 6 and 8 of all of the panels 1, 2 and 4 being secured together and separable from the remainder by pin hole feed strip line perforations 18, marginal edge portions of the remainder of all of the panels 1, 2 and 4 adjacent the pin hole feed strip line perforations 18 being secured together, by glue lines 20, the remainder of the panels 1, 2 and 4 also being secured together, by glue lines 22, along their opposite sides to the flap 10 and having matching envelope opening line perforations 24 adjacent one pin hole feed strip 8, one of the outer panels, in this embodiment the panel 1, having the partition panel 2 secured thereto, by glue line 26, along the side adjacent the flap 10, for forming a prestuffable, sealed compartment therewith, and the other of the outer panels, in this embodiment panel 4, being secured to the partition panel 2, by glue line 28 (FIG. 3) thereon, along an inner marginal edge portion adjacent the envelope opening line perforations 24, whereby the prestuffable, sealed compartment only may be opened by tearing the envelope assembly along the envelope opening line perforations 24.

In FIGS. 5 to 16 similar parts to those shown in FIGS. 1 and 4 are designated by the same reference numerals and the previous description is relied upon to describe them.

In this embodiment a proof-of-delivery for return to the mailer, panel 30 (FIGS. 1 and 5) is provided interleaved between the first panel 1 and the partition panel 2. The panel 30 has a waisted portion 32 so that the waisted portion 32 will be situated in the prestuffable, sealed compartment. The waisted portion 32 has line perforations 34 for, as will be described later removal of a portion 36 when the sealed compartment is opened.

The panel 1 (FIG. 2) has line perforations 38 to 40, which follow the outline of the portion 36 of the panel 30, to provide a removable wall panel portion 42. The flap 10 has an adhesive layer 44 for sealing the envelope assembly.

The panel 2 (FIG. 3) has a cut-away 46 to provide an envelope throat.

The panel 4 (FIG. 4) also has a cut-away 48 to provide an envelope throat.

The panel 30 (FIG. 5) has a cut-away 50 substantially corresponding to the cut away portions 46 and 48 of the panels 2 and 4 respectively.

In this embodiment a mailer record panel 52 (FIG. 6) is provided attached to the outer face of panel 1 as shown in FIG. 1.

A printer feed backing panel 54 (FIG. 7) can also be provided in this embodiment, attached to the outer face of panel 2 as shown chain-dotted in FIG. 1, to ensure proper printing feed and that the cut-away portions 46 and 48 of the panels 2 and 4 respectively do not catch in a printing machine (not shown). The printer feed backing panel 54 can be discarded after printing.

As shown in FIG. 1, data transfer means, for example, in this embodiment carbon transfer sheets 56 are provided between panels 1, 2, 30 and 52. In other embodiments data transfer coatings may be used applied to the surfaces of the panels.

Referring now to FIG. 8 the panels 1, 2, 4, 52 and 54 are assembled as shown as a continuous form from strip (not shown) with the carbon sheets 56 shown in FIG. 1 interleaved between their respective panels. The strips from which each of the panels 1, 2, 4, 52 and the carbon sheets 56 are obtained have perforations for separation in a conventional manner into individual envelope assemblies as shown.

Referring to FIG. 9, the names and addresses of the mailer and the addressee are recorded on the panel 52 at 58 and 60 respectively.

As shown in FIG. 10 the pin hole feed strips 6 and 8 are removed together with the panel 52, the carbon sheet 56 beneath it and panel 54. The panel 52 is retained by the mailer as a record.

The panel 1 is now exposed as shown in FIG. 11 bearing only the name and address 60 of the addressee.

The envelope assembly may be turned around as shown in FIG. 12 and a mail piece 62 inserted in the envelope assembly between the panels 2 and 4 (FIG. 1). Depending on the use, the mail piece 62 can either be inserted mechanically or manually.

The sealing flap 10 is then folded as shown in FIG. 13 and sealed and the envelope assembly is mailed.

Depending on the use the sealing flap 10 can be sealed mechanically or manually.

When the postal employee is delivering the envelope assembly to the addrressee as shown in FIG. 14, he tears the envelope open along the envelope opening line perforations 24.

As shown in FIG. 15, the panel portion 30 and 42, together with the carbon sheet 56 therebetween are then removed and retained by the postal employee. The mail piece 62 (FIG. 12) at this stage is sealed in the remainder of the envelope assembly shown in FIG. 16 which is handed to the addressee. The postal employee retains the panel portions 30 and 42, the panel portion 42 being for retention by the Post Office as a record of delivery and the panel portion 30 being for return mailing to the sender as proof-of-delivery.

I claim:

1. An envelope assembly for manufacture as a prestuffed, continuous form, comprising: two outer panels and a partition panel, all having matching pin hole feed strips along opposed sides of each panel, and an envelope sealing flap, the envelope sealing flap being integral with one of the panels, the envelope sealing flap extending between the pin hole feed strips along a flap side of the panel to which it is attached, the pin hole feed strips of all of the panels being secured together and separable from the remainder by pin hole feed strip line perforations, marginal edge portions of the remainder of all of the panels, adjacent the pin hole feed strip line perforations being secured together, the remainder of all of the panels also being secured together along their opposite side to the flap side, and having matching envelope opening line perforations adjacent one pin hole feed strip, one of the outer panels having the partition panel secured thereto, along the side adjacent the flap, for forming a prestuffable, sealed compartment therewith, and the other of the outer panels being secured to the partition panel along an inner marginal edge portion adjacent the envelope opening line perforations, whereby the prestuffable, sealed compartment only may be opened by tearing the envelope assembly along the envelope opening line perforations.

2. An assembly according to claim 1, wherein the assembly is a certified mail envelope assembly and further includes a proof-of-delivery panel removable secured in the sealed compartment, a mailer record panel removably secured to the outer side of an outer panel, and data transfer means between the mailer record panel, the panel adjacent thereto, the proof-of-delivery panel, and the partition panel.

3. An assembly according to claim 2, wherein the proof-of-delivery panel is removably secured in the assembly by pin hole feed strips and line perforations matching the pin hole feed strips and line perforations in the other panels.

4. An assembly according to claim 3, wherein line perforations define a removable panel portion in the outer panel adjacent to the proof-of-delivery panel for removal therewith.

5. An assembly according to claim 3, which further includes a further panel removably secured to the outer side of an outer panel for retention by a mailer, and data transfer means between the further panel and the outer panel adjacent thereto.

6. An assembly according to claim 1, which further includes a backing panel removably secured by pin hole feed strips and line perforations to an outer panel during manufacture of the envelope assembly as a continuous form.

* * * * *